United States Patent [19]

Richardson et al.

[11] 4,369,701

[45] Jan. 25, 1983

[54] CALLIGRAPHIC APPARATUS AND METHOD

[76] Inventors: William A. Richardson, 608 Snyder Ave.; Douglas A. Richardson, 27 Canterbury La., both of Berkeley Heights, N.J. 07922

[21] Appl. No.: 240,574

[22] Filed: Mar. 4, 1981

[51] Int. Cl.[3] ..... B41F 1/07; B43L 13/10

[52] U.S. Cl. ..... 101/32; 33/25 D; 33/231 R

[58] Field of Search ..... 101/32–34, 101/3 R; 33/18 R, 23 R, 25 R, 25 B, 25 E, 23 D, 23 H, 23 K, 246; 90/13.1, 13.2

[56] References Cited

U.S. PATENT DOCUMENTS

| | | | |
|---|---|---|---|
| 8,991 | 6/1852 | Taylor | 33/25 R |
| 184,493 | 11/1876 | Anderson | 33/25 R |
| 544,367 | 8/1895 | Muehlenbeck | 33/25 R |
| 852,036 | 4/1907 | Rollandet | 33/25 D |
| 1,088,358 | 2/1914 | Nelson | 33/23 R |
| 1,302,646 | 5/1917 | Farnum | 33/23 R |
| 1,471,869 | 10/1923 | Turner | 33/25 R |
| 1,784,152 | 12/1930 | McDonald | 33/25 D |
| 2,199,261 | 4/1940 | Kapp et al. | 90/13.1 |
| 2,213,120 | 8/1940 | Burgess | 33/23 D |
| 2,481,657 | 9/1949 | Gruetiner | 90/13.1 |
| 2,496,781 | 2/1950 | Eichmann | 33/25 R |
| 2,524,636 | 10/1950 | Preis et al. | 33/18 R |
| 2,557,148 | 6/1951 | Schimmel | 33/18 R |
| 2,610,404 | 9/1952 | Compton | 33/23 |
| 2,615,251 | 10/1952 | Edmunds | 33/25 R |
| 2,624,302 | 1/1953 | Meister | 112/102 |
| 2,628,539 | 2/1953 | Neer Gaard | 90/13.5 |
| 2,855,677 | 10/1958 | Scruggs | 33/23 R |
| 2,881,521 | 4/1959 | Pearson, Jr. | 33/25 R |
| 3,570,129 | 3/1971 | Del Vecchio | 33/25 B |
| 3,857,025 | 12/1974 | English et al. | 90/136 |
| 4,193,200 | 3/1980 | Massie | 33/25 B |

FOREIGN PATENT DOCUMENTS

| | | | |
|---|---|---|---|
| 481506 | 3/1952 | Canada | 90/13.5 |
| 309360 | 2/1918 | Fed. Rep. of Germany | 23/25 D |
| 2708248 | 8/1978 | Fed. Rep. of Germany | 33/23 R |
| 791503 | 12/1935 | France | 33/23 R |
| 344931 | 4/1960 | Switzerland | 33/23 |
| 260211 | 12/1927 | United Kingdom | 33/23 R |
| 457479 | 9/1936 | United Kingdom | 33/23 R |

*Primary Examiner*—E. H. Eickholt

*Attorney, Agent, or Firm*—Lerner, David, Littenberg & Samuel

[57] ABSTRACT

Disclosed herein are an attachment, method, and apparatus for producing calligraphic lettering. The attachment, method, and apparatus involve supporting a calligraphic lettering implement such that the lettering implement does not rotate relative to a workpiece to be lettered as the lettering implement is moved over the workpiece to form a desired letter, character, or symbol thereon. There is also disclosed an engraving tool which has a chisel-pointed, carbide steel tip.

38 Claims, 5 Drawing Figures

CALLIGRAPHIC APPARATUS AND METHOD

FIELD OF THE INVENTION

The present invention relates to apparatus and method for producing calligrapic lettering. As used herein, the term "lettering" refers to, among other things, any written, engraved, or printed letter, character, symbol, or combinations thereof.

BACKGROUND OF THE INVENTION

Calligraphy is generally defined as the art of elegant writing wherein each letter, character, or symbol consists of a variable width line or lines. In the past, calligraphic writing has been produced manually using special writing tools, such as quills and chisel-pointed pens. These tools are special in that they must have the ability to produce a variable width line in a single stroke, the width of the line being dependent upon the angular position of the tools relative to a workpiece to be lettered.

The manual production of calligraphic lettering requires a great amount of skill. Accordingly, it can take many years to become a skilled calligrapher. Also, even the skilled calligrapher must work relatively slowly in order to produce authentic calligraphic lettering. Thus, manual calligraphic lettering can be a time-consuming process even for the skilled calligraphers.

SUMMARY OF THE INVENTION

The above-described problems and disadvantages associated with the manual production of calligraphic lettering are overcome by the present invention which involves new and improved apparatus and method adapted to permit the automatic or semi-automatic production of calligraphic lettering. In accordance with one aspect of the invention, the calligraphic apparatus and method employ holding means for holding a workpiece to be lettered by calligraphic lettering means, such as a chisel-pointed lettering implement. Following means, such as a stylus, is also provided for following single-line indicia fixedly positioned relative to the workpiece. Connecting means, such as a pantographic mechanism, connects the lettering means to the following means such that the movement of the lettering means copies the movement of the following means. The lettering means is attached to the connecting means by attaching means which functions such that the lettering means continuously and automatically rotates relative to the connecting means without rotating relative to the workpiece during the movement of the lettering means as it copies the movement of the following means, whereby the single-line indicia may be used to produce calligraphic lettering on the workpiece.

The attaching means may be manufactured separately as an attachment adapted to be retrofitted onto conventional engraving machines, so that the machines can be used to produce calligraphic lettering. More particularly, this attachment would replace the conventional engraving tool normally employed in connection with conventional engraving machines. By removing the attachment and replacing it with the original engraving tool, the engraving machines could be reequipped to perform non-calligraphic engraving operations. Thus, the present invention increases the versatility of conventional engraving machines by permitting them to perform calligraphic lettering operations, as well as non-calligraphic engraving operations.

In one embodiment, the attaching means includes a spindle, having a first end, a second end and first receiving means formed in the first end for fixedly receiving calligraphic lettering means such that the lettering means does not rotate relative to the spindle. The spindle is attached to a pantographic mechanism of a conventional engraving machine such that the spindle rotates relative to the pantographic mechanism without rotating relative to a workpiece to be lettered during the movement of the lettering means as it copies the movement of a stylus of the engraving machine. A collar is fixedly attached to the second end of the spindle. The collar is pivotally attached to a support rod, which is slideably received in a carriage such that said support rod moves in a first direction relative to the carriage in response to the movement of the pantographic mechanism in the first direction. The carriage is slideably supported such that it can be moved in a second direction, generally perpendicular to the first direction, in response to the movement of the pantographic mechanism in the second direction. If the lettering means is a chisel-pointed lettering implement, the attaching means may also include adjusting means for adjusting the angular position of the writing implement relative to the workpiece, whereby the writing implement may be used to produce several different styles of calligraphic lettering.

For engraving operations, the lettering implement may be provided with a chisel-pointed tip having an included angle in a range of from 80° to 120°. Preferably, the tip is made from solid carbide steel and has an included angle of 100°.

BRIEF DESCRIPTION OF THE DRAWINGS

For a more complete understanding of the present invention, reference may be had to the following description of an exemplary embodiment considered in connection with the figures of the accompanying drawings, in which.

DESCRIPTION OF AN EXEMPLARY EMBODIMENT

Figure 1A:
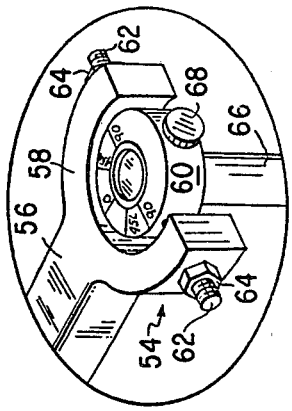
FIG. 1*a* is a detailed perspective view of a portion of the calligraphic attachment of FIG. 1.
Figure 1:
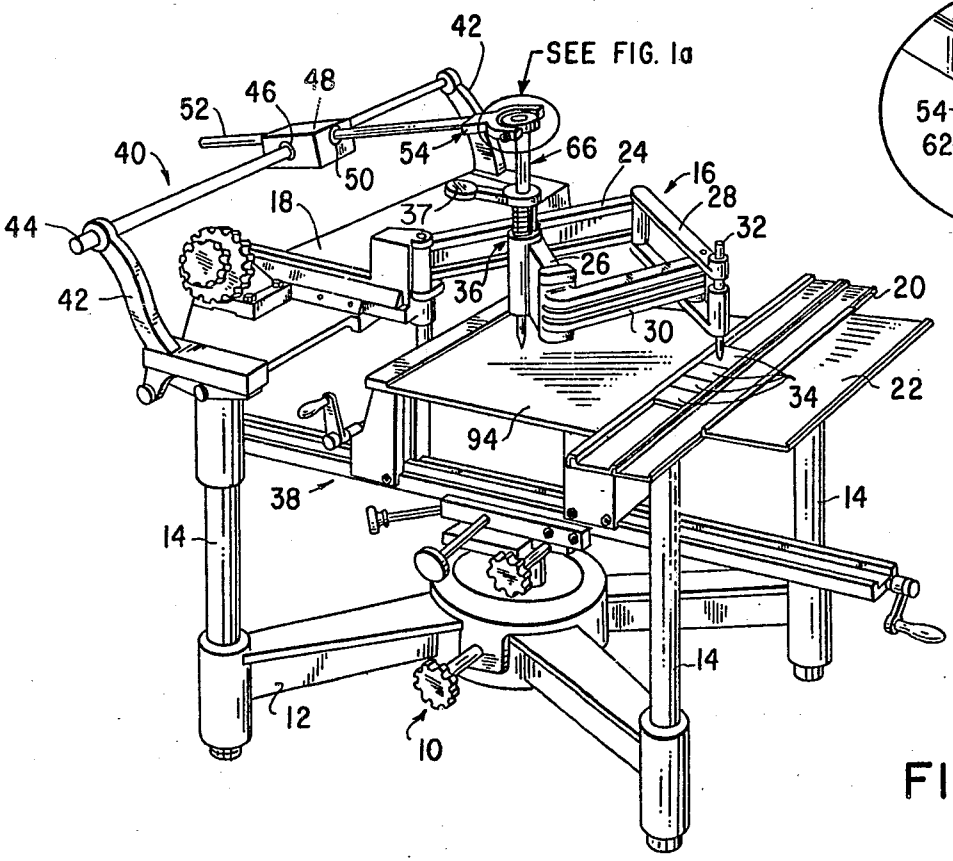
FIG. 1 is a perspective view of a conventional engraving machine which is retrofitted with a calligraphic attachment constructed in accordance with the present invention.

Referring to the drawings, a conventional jewelry engraving machine 10, such as a commercially available Hermes Model TX, GTX, ITFK or ITX, normally includes a base 12 which has four vertical posts 14 mounted thereon. The posts 14 support a pantographic mechanism 16, which is adjustably positioned on a support member 18 extending between two of the posts 14.

The other two posts 14 support a master copy type holder 20 which is mounted on a platform 22.

The pantographic mechanism 16 has a main support arm 24 which is pivotally mounted to the support member 18. The pantographic mechanism 16 also includes two legs 26, 28 which are pivotally attached to the main support arm 24. Another leg 30 is pivotally connected to the legs 26, 28. The main support arm 24 cooperates with the legs 26, 28, 30 to form a parallelogram.

The leg 28 carries a stylus 32, which is adapted to follow a guide groove (not shown) formed in master copy type 34 positioned in the master copy type holder 20. An engraving tool holder 36, which includes a depressable lever arm 37, is carried by the leg 26.

A vice-type clamping device 38 is positioned below the pantographic mechanism 16. The clamping device 38 is adapted to mount various objects, such as trophies, to be engraved by the engraving machine 10.

The engraving machine 10 is retrofitted with an attachment 40 including a pair of supporting brackets 42, 42, each of which is removably attached to the support member 18 of the engraving machine 10. A rail 44 extends horizontally between the support brackets 42, 42. The rail 44 extends through a lower linear bearing 46 in a carriage 48, which is mounted for sliding movement along the rail 44. An upper linear bearing 50 mounted in the carriage 48 slideably receives a control rod 52 which carries a spindle support assembly 54.

With particular reference to FIG. 1*a*, the spindle support assembly 54 includes a fork 56 having a yoke portion 58. A collar 60 is pivotally mounted within the yoke portion 58 of the fork 56 by two threaded mounting pins 62, 62, which are releasably locked to the yoke portion 58 of the fork 56 by lock nuts 64, 64. The collar 60 is provided with settings identified as O,45R, 45L and 90. These settings will be described in more detail hereinafter. A spindle assembly 66 extends through the collar 60 and is locked in place by a set screw 68, which extends radially through the collar 60.

Figure 2:
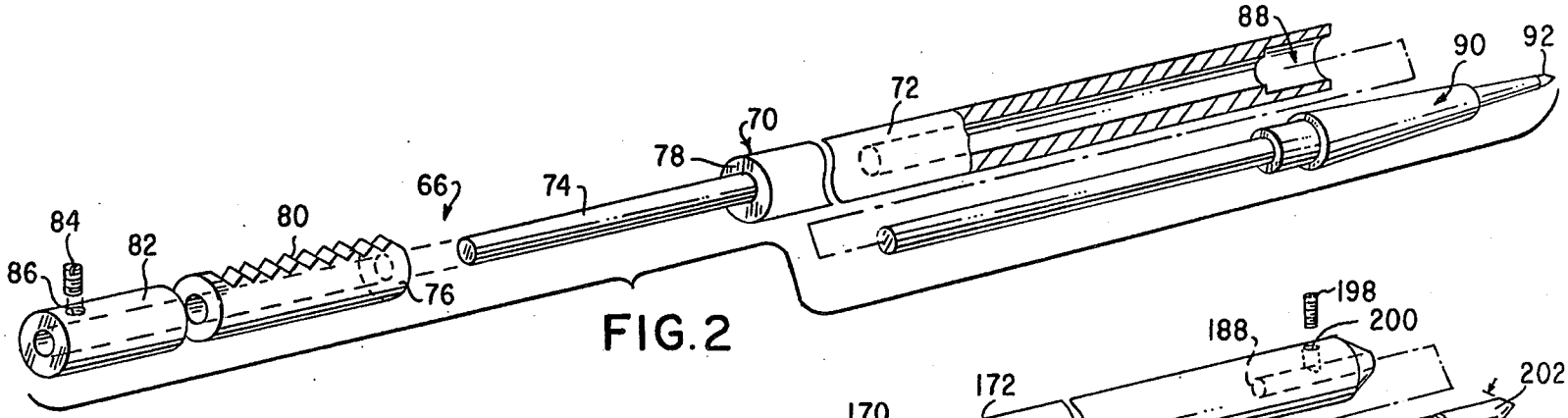
FIG. 2 is an exploded view of one embodiment of a spindle adapted for use in connection with the attachment shown in FIG. 1.

Referring now to FIG. 2, the spindle assembly 66 includes a holding member 70 having a large diameter portion 72 and a small diameter portion 74. A long sleeve 76 is slideably and rotatably positioned on the small diameter portion 74 of the holding member 70. The long sleeve 76 has an outer diameter which corresponds to the outer diameter of the large diameter portion 72 of the holding member 70 and an inner diameter which is slightly larger than the diameter of the small diameter portion 74 of the holding member 70. The long sleeve 76 is shorter than the small diameter portion 74 of the holding member 70 so that the small diameter portion 74 extends beyond the long sleeve 76 when the long sleeve 76 engages a shoulder 78 formed where the small diameter portion 74 meets the large diameter portion 72. A flat knurled surface 80 is formed on the long sleeve 76 for providing a gripping surface for a set screw (not shown) carried by the engraving tool holder 36 of the engraving machine 10. The small diameter portion 74 of the holding member 70 slideably and removably receives a short sleeve 82. The short sleeve 82 is locked in place on the small diameter portion 74 by a set screw 84 which extends through a threaded aperture 86 provided in the short sleeve 82. The large diameter portion 72 of the holding member 70 has a cavity 88, which is sized and shaped so as to removably but nonrotatably receive a cartridge and tip portion 90 of an art pen, such as the one made and sold by Everhard Faber, Inc., having a chisel-pointed tip 92. Because the long sleeve 76 is fixedly attached to the engraving tool holder 36 of the engraving machine 10, the holding member 70, which rotatably receives the long sleeve 76, is continuously and automatically rotatable relative to the engraving tool holder 36 and therefore the pantographic mechanism 16 of the engraving machine 10. The spindle support assembly 54, the support rod 52, and the carriage 48 cooperate to maintain a predetermined angular position of the holding member 70 and hence the chisel-pointed tip 92 relative to a workpiece held by the clamping device 38 of the engraving machine 10.

In operation, before or after attaching the support brackets 42, 42, the rail 44, the carriage 48, the control rod 52 and the spindle support assembly 54 to the engraving machine 10, the original engraving tool is removed from the engraving tool holder 36 and replaced by the spindle assembly 66. After attaching the spindle assembly 66 to the spindle support assembly 54, the master copy type 34 is positioned in the master copy type holder 20 of the engraving machine 10. The workpiece to be engraved or printed is then placed on a support plate 94, which is fixedly positioned by the clamping device 38 of the engraving machine 10. The support plate 94 is preferably made of steel, so that magnets may be employed to hold the workpiece to the support plate 94. Alternatively, the workpiece may be supported directly by the clamping device 38, without the aid of the support plate 94.

In order to achieve a desired calligraphic style of lettering, the holding member 70 is set at a desired setting, which represents the angular position of the holding member 70 and hence the chisel-pointed tip 92 relative to the workpiece. After the desired setting has been selected, the stylus 32 is inserted into the guide groove formed in the master copy type 34. The guide groove typically defines a single-line character, letter, or symbol. The lever arm 37 is depressed so that the chisel-pointed tip 92 contacts the workpiece. The stylus 32 is manually moved so that it follows the guide groove of the master copy type 34 to form the letter, character, or symbol defined thereby. The lettering style can be varied by changing the settings without changing the master copy type 34. For instance, a different style may be obtained by loosening the set screw 68 and rotating the holding member 70 to a new setting. The set screw 68 is then tightened to maintain the holding member 70 at the new setting.

Figure 4:
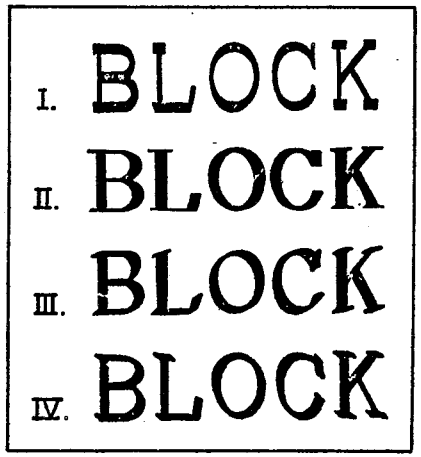
FIG. 4 is a plan view of a plate having the word "BLOCK" printed thereon and shown in four different calligraphic styles obtainable with the retrofitted apparatus of FIG. 1.

FIG. 4 shows four different styles of calligraphic lettering obtainable by equipping the engraving machine 10 with the attachment 40. All of these styles are obtainable by using the same single-line master copy type 34. More particularly, style I is produced when the spindle assembly 66 is set at the 0° setting, so that the chisel-pointed tip 92 creates a thin line when it is moved vertically and a thick line when it is moved horizontally. The spindle assembly 66 is set at the 90° setting for style II. The 90° setting causes the chisel-pointed tip 92 to create a thin line when it is moved horizontally and a thick line when it is moved vertically. Styles III and IV are produced by positioning the spindle assembly 66 at the 45° R and 45° L settings, respectively, whereby the chisel-pointed tip 92 makes a thin line when it is moved at a 45° angle and a thick line when it is moved at an opposite 45° angle. Other styles may, of course, be obtained simply by establishing additional settings.

Figure 3:
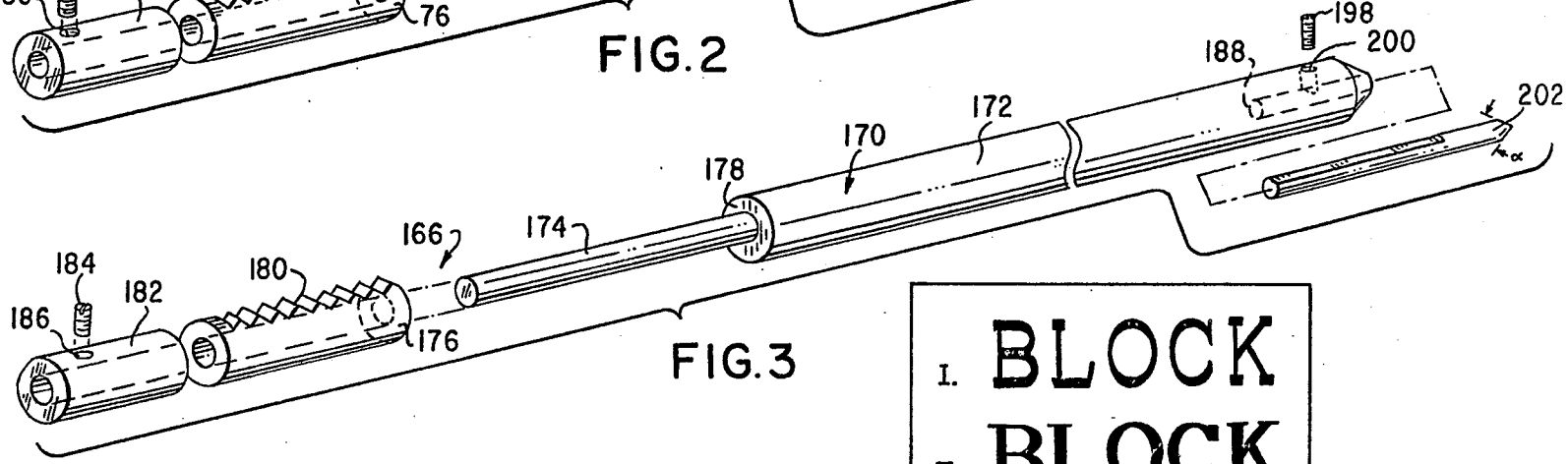
FIG. 3 is an exploded view of a second embodiment of a spindle adapted for use in connection with the attachment illustrated in FIG. 1.

Another exemplary embodiment of the spindle assembly 66 is illustrated in FIG. 3. The various elements illustrated in FIG. 3 which correspond to elements described above in connection with the embodiment of FIG. 2 have been designated by corresponding reference numbers increased by 100. The embodiment of FIG. 3 operates in the same manner as the embodiment of FIG. 2, unless otherwise stated.

Referring now to FIG. 3, a holding member 170 is provided with a cavity 188 having a size and shape selected so as to releasably receive an engraving implement 196. A set screw 198, which is threadedly received in a hole 200 provided in a large diameter portion 172 of the holding member 170, prevents the engraving implement 196 from rotating relative to the holding member 170. The engraving implement 196 has a chisel-pointed tip 202 having an included angle $\alpha$ which is in the range of from about 80° to about 120° and preferably about 100°. The engraving implement 196, including the chisel-pointed tip 202, is made from solid carbide steel.

It will be understood that the embodiment described herein is merely exemplary and that a person skilled in the art may make many variations and modifications without departing from the spirit and scope of the invention. For instance, the attachment 40 may be provided as original equipment on an engraving machine or a similar device. All such modifications and variations are intended to be included within the scope of the invention as defined in the appended claims.

What we claimed is:

1. A method of producing calligraphic lettering employing apparatus including holding means for holding a workpiece to be lettered, lettering means for lettering a workpiece held by said holding means, positioning means for fixedly positioning single-line indicia relative to a workpiece held by said holding means, following means for following single-line indicia fixedly positioned by said positioning means, connecting means for connecting said lettering means to said following means such that the movement of said lettering means copies the movement of said following means, said method comprising the step of attaching said lettering means to said connecting means such that said lettering means continuously and automatically rotates relative to said connecting means without rotating relative to a workpiece held by said holding means during the movement of said lettering means as it copies the movement of said following means, whereby single-line indicia fixedly positioned by said positioning means may be used to produce calligraphic lettering on a workpiece held by said holding means.

2. A method of retrofitting engraving apparatus which normally include holding means for holding a workpiece to be engraved, engraving means for engraving a workpiece held by said holding means, positioning means for fixedly positioning indicia relative to a workpiece held by said holding means, following means for following indicia fixedly positioned by said positioning means, connecting means for connecting said engraving means to said following means such that the movement of said engraving means copies the movement of said following means, said method comprising the step of replacing said engraving means with an attachment including lettering means for calligraphically lettering a workpiece held by said holding means and attaching means for attaching said lettering means to said connecting means such that said lettering means continuously and automatically rotates relative to said connecting means without rotating relative to a workpiece held by said holding means during the movement of said lettering means as it copies the movement of said following means, whereby single-line indicia fixedly positioned by said positioning means may be used to produce calligraphic lettering on a workpiece held by said holding means.

3. Calligraphic apparatus, comprising holding means for holding a workpiece to be lettered, lettering means for calligraphically lettering a workpiece held by said holding means, positioning means for fixedly positioning single-line indicia relative to a workpiece held by said holding means, following means for following single-line indicia fixedly positioned by said positioning means, connecting means for connecting said lettering means to said following means such that the movement of said lettering means copies the movement of said following means, and attaching means for attaching said lettering means to said connecting means such that said lettering means continuously and automatically rotates relative to said connecting means without rotating relative to a workpiece held by said holding means during the movement of said lettering means as it copies the movement of said following means, whereby single-line indicia fixedly positioned by said positioning means may be used to produce calligraphic lettering on a workpiece held by said holding means.

4. Apparatus according to claim 3, wherein said connecting means includes a pantographic mechanism and a spindle holder fixedly attached to said pantographic mechanism.

5. Apparatus according to claim 4, wherein said attaching means includes a spindle, having a first end, a second end and first receiving means formed in said first end for fixedly receiving said lettering means such that said lettering means does not rotate relative to said spindle; mounting means for mounting said spindle in said spindle holder such that said spindle rotates relative to said spindle holder without rotating relative to a workpiece held by said holding means during the movement of said lettering means as it copies the movement of said following means; a collar fixedly attached to said second end of said spindle; a support rod pivotally attached to said collar; a carriage, including second receiving means for slideably receiving said support rod such that said support rod is movable in a first direction relative to said carriage in response to the movement of said pantographic mechanism in said first direction; and supporting means for slideably supporting said carriage such that said carriage is movable in a second direction, generally perpendicular to said first direction, in response to the movement of said pantographic mechanism in said second direction.

6. Apparatus according to claim 5, wherein said lettering means is a chisel-pointed lettering implement.

7. Apparatus according to claim 6, wherein said lettering implement is a pen.

8. Apparatus according to claim 6, wherein said lettering implement is an engraving tool.

9. Apparatus according to claim 6, wherein said attaching means includes adjusting means for adjusting the angular position of said lettering implement relative to a workpiece held by said holding means, whereby said lettering implement may produce several different styles of calligraphic lettering.

10. An attachment for engraving apparatus which normally include holding means for holding a workpiece to be lettered, positioning means for fixedly positioning single-line indicia relative to a workpiece held by said holding means, a pantographic mechanism, and following means attached to said pantographic mechanism for following single-line indicia fixedly positioned by said positioning means, said attachment including lettering means for calligraphically lettering a workpiece held by said holding means and attaching means for attaching said lettering means to said pantographic mechanism such that the movement of said lettering means copies the movement of said following means and such that said lettering means continuously and automatically rotates relative to said pantographic mechanism without rotating relative to a workpiece held by said holding means during the movement of said lettering means as it copies the movement of said following means, whereby single-line indicia fixedly positioned by said positioning means may be used to produce calligraphic lettering on a workpiece held by said holding means.

11. An attachment according to claim 10, wherein said pantographic mechanism includes a spindle holder.

12. An attachment according to claim 11, wherein said attaching means includes a spindle, having a first end, a second end and first receiving means formed in said first end for fixedly receiving said lettering means such that said lettering means does not rotate relative to said spindle; mounting means for mounting said spindle in said spindle holder such that said spindle rotates relative to said spindle holder without rotating relative to a workpiece held by said holding means during the movement of said lettering means as it copies the movement of said following means; a collar fixedly attached to said second end of said spindle; a support rod pivotally attached to said collar; a carriage, including second receiving means for slideably receiving said support rod such that said support rod is movable in a first direction relative to said carriage in response to the movement of said pantographic mechanism in said first direction; and supporting means for slideably supporting said carriage such that said carriage is movable in a second direction, generally perpendicular to said first direction, in response to the movement of said pantographic mechanism in said second direction.

13. An attachment according to claim 12, wherein said lettering means is a chisel-pointed lettering implement.

14. An attachment according to claim 13, wherein said lettering implement is a pen.

15. An attachment according to claim 13, wherein said lettering implement is an engraving tool.

16. An attachment according to claim 13, wherein said attaching means includes adjusting means for adjusting the angular position of said lettering implement relative to a workpiece held by said holding means, whereby said lettering implement may produce several different styles of calligraphic lettering.

17. In engraving apparatus which normally include holding means for holding a workpiece to be lettered, positioning means for fixedly positioning indicia relative to a workpiece held by said holding means, a pantographic mechanism, and following means attached to said pantographic mechanism for following indicia fixedly positioned by said positioning means, the improvement wherein said apparatus is retrofitted with an attachment including lettering means for calligraphically lettering a workpiece held by said holding means and attaching means for attaching said lettering means to said pantographic mechanism such that the movement of said lettering means copies the movement of said following means and such that said lettering means continuously and automatically rotates relative to said pantographic mechanism without rotating relative to a workpiece held by said holding means during the movement of said lettering means as it copies the movement of said following means, whereby single-line indicia fixedly positioned by said positioning means may be used to produce calligraphic lettering on a workpiece held by said holding means.

18. Improved apparatus according to claim 17, wherein said pantographic mechanism includes a spindle holder.

19. Improved apparatus according to claim 16, wherein said attaching means includes a spindle, having a first end, a second end and first receiving means formed in said first end for fixedly receiving said lettering means such that said lettering means does not rotate relative to said spindle; mounting means for mounting said spindle in said spindle holder such that said spindle rotates relative to said spindle holder without rotating relative to a workpiece held by said holding means during the movement of said lettering means as it copies the movement of said following means; a collar fixedly attached to said second end of said spindle; a support rod pivotally attached to said collar; a carriage, including second receiving means for slideably receiving said support rod such that said support rod is movable in a first direction relative to said carriage in response to the movement of said pantographic mechanism in said first direction; and supporting means for slideably supporting said carriage such that said carriage is movable in a second direction, generally perpendicular to said first direction, in response to the movement of said pantographic mechanism in said second direction.

20. Improved apparatus according to claim 19, wherein said lettering means is a chisel-pointed lettering implement.

21. Improved apparatus according to claim 20, wherein said lettering implement is a pen.

22. Improved apparatus according to claim 20, wherein said lettering implement is an engraving tool.

23. Improved apparatus according to claim 20, wherein said attaching means includes adjusting means for adjusting the angular position of said lettering implement relative to a workpiece held by said holding means, whereby said lettering implement may produce several different styles of calligraphic lettering.

24. Calligraphic apparatus, comprising holding means for holding a workpiece to be lettered; lettering means for calligraphically lettering a workpiece held by said holding means; positioning means for fixedly positioning single-line indicia relative to a workpiece held by said holding means; following means for following single-line indicia fixedly positioned by said positioning means; connecting means for connecting said lettering means to said following means such that the movement of said lettering means copies the movement of said following means, said connecting means including a pantographic mechanism and a spindle holder fixedly attached to said pantographic mechanism; and attaching means for attaching said lettering means to said connecting means such that said lettering means rotates relative to said connecting means without rotating relative to a workpiece held by said holding means during the movement of said lettering means as it copies the movement of said following means, whereby single-line indicia fixedly positioned by said positioning means may be used to produce calligraphic lettering on a workpiece held by said holding means, said attaching means including a spindle, having a first end, a second end and first receiving means formed in said first end for fixedly receiving said lettering means such that said lettering means does not rotate relative to said spindle, mounting means for mounting said spindle in said spindle holder such that said spindle rotates relative to a workpiece held by said holding means during the movement of said lettering means as it copies the movement of said following means, a collar fixedly attached to said second end of said spindle, a support rod pivotally attached to said collar, a carriage, including second receiving means for slideably receiving said support rod such that said support rod is movable in a first direction relative to said carriage in response to the movement of said pantographic mechanism in said first direction, and supporting means for slideably supporting said carriage such that said carriage is movable in a second direction, generally perpendicular to said first direction, in response to the movement of said pantographic mechanism in said second direction.

25. Apparatus according to claim 24, wherein said lettering means is a chisel-pointed lettering implement.

26. Apparatus according to claim 25, wherein said lettering implement is a pen.

27. Apparatus according to claim 25, wherein said lettering implement is an engraving tool.

28. Apparatus according to claim 25, wherein said attaching means further includes adjusting means for adjusting the angular position of said lettering implement relative to a workpiece held by said holding means, whereby said lettering implement may produce several different styles of calligraphic lettering.

29. An attachment for engraving apparatus which normally include holding means for holding a workpiece to be lettered, positioning means for fixedly positioning single-line indicia relative to a workpiece held by said holding means, a pantographic mechanism, a spindle holder attached to said pantographic mechanism, and following means attached to said pantographic mechanism for following single-line indicia fixedly positioned by said positioning means, said attachment including lettering means for calligraphically lettering a workpiece held by said holding means and attaching means for attaching said lettering means to said pantographic mechanism such that the movement of said lettering means copies the movement of said following means and such that said lettering means rotates relative to said pantographic mechanism without rotating relative to a workpiece held by said holding means during the movement of said lettering means as it copies the movement of said following means, whereby single-line indicia fixedly positioned by said positioning means may be used to produce calligraphic lettering on a workpiece held by said holding means, said attaching means including a spindle, having a first end, a second end and a first receiving means formed in said first end for fixedly receiving said lettering means such that said lettering means does not rotate relative to said spindle, mounting means for mounting said spindle in said spindle holder such that said spindle rotates relative to said spindle holder without rotating relative to a workpiece held by said holding means during the movement of said lettering means as it copies the movement of said following means, a collar fixedly attached to said second end of said spindle, a support rod pivotally attached to said collar, a carriage, including second receiving means for slideably receiving said support rod such that said support rod is movable in a first direction relative to said carriage in response to the movement of said pantographic mechanism in said first direction, and supporting means for slideably supporting said carriage such that said carriage is movable in a second direction, generally perpendicular to said first direction, in response to the movement of said pantographic mechanism to said second direction.

30. An attachment according to claim 29, wherein said lettering means is a chisel-pointed lettering implement.

31. An attachment according to claim 30, wherein said lettering implement is a pen.

32. An attachment according to claim 30, wherein said lettering implement is an engraving tool.

33. An attachment according to claim 30, wherein said attaching means includes adjusting means for adjusting the angular position of said lettering implement relative to a workpiece held by said holding means, whereby said lettering implement may produce several different styles of calligraphic lettering.

34. In engraving apparatus which normally include holding means for holding a workpiece to be lettered, positioning means for fixedly positioning indicia relative to a workpiece held by said holding means, a pantographic mechanism, a spindle holder attached to said pantographic mechanism, and following means attached to said pantographic mechanism for following indicia fixedly positioned by said positioning means, the improvement wherein said apparatus is retrofitted with an attachment including lettering means for calligraphically lettering a workpiece held by said holding means and attaching means for attaching said lettering means to said pantographic mechanism such that the movement of said lettering means copies the movement of said following means and such that said lettering means rotates relative to said pantographic mechanism without rotating relative to a workpiece held by said holding means during the movement of said lettering means as it copies the movement of said following means, whereby single-line indicia fixedly positioned by said positioning means may be used to produce calligraphic lettering on a workpiece held by said holding means, said attaching means including a spindle, having a first end, a second end and first receiving means formed in said first end for fixedly receiving said lettering means such that said lettering means does not rotate relative to said spindle, mounting means for mounting said spindle in said spindle holder such that said spindle rotates relative to said spindle holder without rotating relative to a workpiece held by said holding means during the movement of said lettering means as it copies the movement of said following means, a collar fixedly attached to said second end of said spindle, a support rod pivotally attached to said collar, a carriage, including second receiving means for slideably receiving said support rod such that said support rod is movable in a first direction relative to said carriage in response to the movement of said pantographic mechanism in said first direction, and supporting means for slideably supporting said carriage such that said carriage is movable in a second direction, generally perpendicular to said first direction, in response to the movement of said pantographic mechanism in said second direction.

35. Improved apparatus according to claim 34, wherein said lettering means is a chisel-pointed lettering implement.

36. Improved apparatus according to claim 35, wherein said lettering implement is a pen.

37. Improved apparatus according to claim 35, wherein said lettering implement is an engraving tool.

38. Improved apparatus according to claim 35, wherein said attaching means includes adjusting means for adjusting the angular position of said lettering implement relative to a workpiece held by said holding means, whereby said lettering implement may produce several different styles of calligraphic lettering.

* * * * *

UNITED STATES PATENT AND TRADEMARK OFFICE

CERTIFICATE OF CORRECTION

PATENT NO. : 4,369,701

DATED : January 25, 1983

INVENTOR(S) : RICHARDSON ET AL.

It is certified that error appears in the above-identified patent and that said Letters Patent are hereby corrected as shown below:

Column 8, line 11, "16" should read --18--.
Column 10, line 6, "to" should read --in--.

Signed and Sealed this

*Seventh* Day of *June 1983*

[SEAL]

*Attest:*

DONALD J. QUIGG

*Attesting Officer*

*Acting Commissioner of Patents and Trademarks*